US008193138B2

(12) United States Patent
Nekmard

(10) Patent No.: US 8,193,138 B2
(45) Date of Patent: Jun. 5, 2012

(54) AQUEOUS HIGHLY ACIDIC HARD SURFACE CLEANING COMPOSITIONS

(75) Inventor: Farid Ahmad Nekmard, Lodi, NJ (US)

(73) Assignee: Reckitt Benckiser LLC, Parsippany, NJ (US)

( * ) Notice: Subject to any disclaimer, the term of this patent is extended or adjusted under 35 U.S.C. 154(b) by 93 days.

(21) Appl. No.: 12/444,210

(22) PCT Filed: Nov. 30, 2007

(86) PCT No.: PCT/GB2007/004588
§ 371 (c)(1),
(2), (4) Date: Jan. 13, 2010

(87) PCT Pub. No.: WO2008/068463
PCT Pub. Date: Jun. 12, 2008

(65) Prior Publication Data

US 2010/0144581 A1 Jun. 10, 2010

Related U.S. Application Data

(60) Provisional application No. 60/868,746, filed on Dec. 6, 2006.

(51) Int. Cl.
*C11D 17/00* (2006.01)

(52) U.S. Cl. ..... 510/218; 510/425; 510/427; 510/506

(58) Field of Classification Search ..... None
See application file for complete search history.

(56) References Cited

U.S. PATENT DOCUMENTS 6,583,103 B1 6/2003 Klinkhammer
2002/0187918 A1* 12/2002 Urban ..... 510/505
2008/0139443 A1* 6/2008 Buzinski et al. ..... 510/362

FOREIGN PATENT DOCUMENTS

GB 2306500 A 5/1997
WO 2007104921 A 9/2007

* cited by examiner

*Primary Examiner* — Necholus Ogden, Jr.
(74) *Attorney, Agent, or Firm* — Norris McLaughlin & Marcus PA

(57) ABSTRACT

Provided are highly aqueous liquid acidic hard surface cleaning compositions having a pH of about 3 or less which comprise: an acid constituent, preferably comprising a ternary acid system consisting formic acid, sulfamic acid and oxalic acid, optionally at least one or more further co-acids; at least one nonionic surfactant based on monobranched alkoxylated C10/C11-fatty alcohols; an organic solvent constituent which comprises at least one glycol ether solvent, preferably a glycol ether solvent which desirably mitigates or masks malodors of the acid constituent, especially when the acid constituent comprises formic acid; optionally a cosurfactant constituent, including one or more nonionic, cationic, amphoteric or zwitterionic surfactants but preferably one or more nonionic surfactants and excluding cationic, amphoteric or zwitterionic surfactants; optionally one or more further constituents selected coloring agents, fragrances and fragrance solubilizers, viscosity modifying agents including one or more thickeners, pH adjusting agents and pH buffers including organic and inorganic salts, optical brighteners, opacifying agents, hydrotropes, abrasives, and preservatives, as well as other optional constituents known to the art; and the balance, water, wherein water comprises at least 80% wt. of the composition.

11 Claims, No Drawings

AQUEOUS HIGHLY ACIDIC HARD SURFACE CLEANING COMPOSITIONS

This is an application filed under 35 USC 371 of PCT/GB2007/004588.

The present invention relates to aqueous acidic hard surface cleaning compositions.

Hard surface cleaning compositions are commercially important products and enjoy a wide field of use, and are known in assisting in the removal of dirt and grime from surfaces, especially those characterized as useful for cleaning "hard surfaces". Hard surfaces include those which are frequently encountered in lavatories, for example lavatory fixtures such as toilets, shower stalls, bathtubs, bidets, sinks, etc., as well as countertops, walls, floors, etc. In such lavatory environments two types of commonly encountered stains in lavatories include "hard water" stains, "soap scum" stains as well as "rust stains". Such hard surfaces, and such stains, may also be found in different environments as well, including kitchens, hospitals, etc. Hard water stains are mineral stains caused by the deposition of salts, such as calcium or magnesium salts which are frequently present in hard water which is commonly encountered. Soap scum stains are residues of fatty acid soaps, such as soaps which are based on alkaline salts of low fatty acids. These fatty acids are known to precipitate in hard water due to the presence of metal salts therein leaving an undesirable residue upon such surfaces. Still further stains, typically referred to as greasy stains, are surface residues which generally comprise hydrophobic materials often with further materials which leave unsightly residues on surfaces. Rust stains are typically formed by the presence of undesired amounts of iron oxides in water which may form unsightly deposits on hard surfaces.

While the prior art provides a variety of compositions which provide effective cleaning of one or more, typically all of the foregoing classes of stains, there is still an urgent need in the art to provide improved hard surface cleaning compositions which are effective in the treatment of many types of stains typically encountered on hard surfaces, particularly in a home or commercial environment, especially in or around kitchens, bathrooms where cleanliness is of especial importance. It is to such needs that the compositions of the present invention are particularly directed.

Broadly, the present invention relates to liquid acidic hard surface cleaning compositions which are effective against common stains encountered on hard surfaces.

In one specific aspect there is provided a highly aqueous liquid acidic hard surface cleaning composition having a pH of about 3 or less which necessarily comprises:

an acid constituent, comprising a ternary acid system which includes each of formic acid, oxalic acid, and sulfamic acid, and which acid constituent optionally further comprises at least one or more further co-acids, and preferably wherein the acid constituent consists essentially of the ternary acid system in the absence of any further co-acids;

at least one nonionic surfactant based on monobranched alkoxylated C10/C11-fatty alcohols;

an organic solvent constituent which comprises at least one glycol ether solvent, preferably a glycol ether solvent which mitigates or masks malodors of the acid constituent, especially when the acid constituent comprises formic acid;

optionally a cosurfactant constituent, including one or more nonionic, cationic, amphoteric or zwitterionic surfactants;

optionally one or more further constituents selected coloring agents, fragrances and fragrance solubilizers, viscosity modifying agents including one or more thickeners, pH adjusting agents and pH buffers including organic and inorganic salts, optical brighteners, opacifying agents, hydrotropes, abrasives, and preservatives, as well as other optional constituents known to the art;

and the balance, water, wherein water comprises at least 80% wt. of the composition.

In certain preferred embodiments the nonionic surfactant based on monobranched alkoxylated C10/C11-fatty alcohols is the sole surfactant constituent present in the compositions, to the exclusion of further nonionic, cationic, amphoteric or zwitterionic surfactants.

In a still further preferred embodiment, the nonionic surfactant based on monobranched alkoxylated C10/C11-fatty alcohols is present with one or more nonionic cosurfactants optionally with one or more further nonionic co-surfactants, and further preferably to the exclusion of further non-nonionic surfactants particularly cationic, amphoteric or zwitterionic surfactants.

In yet further preferred embodiments the compositions expressly include one or more glycol ethers solvents.

In further preferred embodiments there are provided carrier substrates, e.g., wipes, sponges, and the like comprising a highly aqueous liquid acidic hard surface cleaning composition as described herein.

The present invention also provides for methods for the treatment of stained hard surfaces in need of cleaning which comprises the step of applying a cleaning effective amount of the acidic hard surface cleaning composition as described herein to a hard surface in need of a cleaning treatment.

The present invention also provides for compositions which exhibit good cleaning properties against dirt and stains commonly found in household, commercial and residential settings, particularly in lavatory settings wherein soap scum stains are frequently encountered.

In a further aspect, the invention provides for acidic hard surface cleaning and/or disinfecting or sanitizing compositions which includes one or more specific glycol ether solvents which inhibit the trigeminal response of a human subject exposed to the said composition especially when the said composition is aerosolized or otherwise sprayed.

It is contemplated that due to the highly acidic pH of the inventive compositions, in addition to good cleaning of a variety of stains commonly encountered on hard surfaces, the inventive compositions may also provide a disinfecting or sanitizing benefit of hard surfaces wherein the presence of undesired microorganisms are suspected such as gram positive or gram negative bacteria.

These and further aspects of the invention including especially preferred aspects will become more apparent from the instant specification.

The compositions of the invention necessarily comprise an acid constituent, which necessarily includes a ternary acid system comprising formic, sulfamic and oxalic acid, optionally with least one or more further co-acids. These co-acids, if present, may be one or more water soluble inorganic acids, mineral acids, or water soluble organic acids, with virtually all such known materials contemplated as being useful in the present inventive compositions. Exemplary inorganic acids for use as co-acids in the present invention include phosphoric acid, potassium dihydrogenphosphate, sodium dihydrogenphosphate, sodium sulfite, potassium sulfite, sodium pyrosulfite (sodium metabisulfite), potassium pyrosulfite (potassium metabisulfite), acid sodium hexametaphosphate, acid potassium hexametaphosphate, acid sodium pyrophosphate, acid potassium pyrophosphate and sulfamic acid. Alkyl sulfonic acids, e.g., methane sulfonic acid may also be used as a co-acid component of the acid system. Strong inorganic acids such as hydrochloric acid, nitric acid and sulfuric acid may also be used, however are less preferred due to their strong acidic character; if present are present in only minor amounts. However, the use of water soluble acids as co-acids are preferred, including water soluble salts of organic acids. Exemplary organic acids are those which generally include at least one carbon atom, and include at least one carboxyl group (—COOH) in its structure. Exemplary useful water soluble organic acids which contain from 1 to about 6 carbon atoms, and at least one carboxyl group as noted. Exemplary useful organic acids include: linear aliphatic acids such as acetic acid, citric acid, propionic acid, butyric acid and valeric acid; dicarboxylic acids such as malonic acid, succinic acid, glutaric acid, adipic acid, pimelic acid, fumaric acid and maleic acid; acidic amino acids such as glutamic acid and aspartic acid; and hydroxy acids such as glycolic acid, lactic acid, hydroxyacrylic acid, α-hydroxybutyric acid, glyceric acid, tartronic acid, malic acid, tartaric acid and citric acid, as well as acid salts of these organic acids. The use of water soluble acids are preferred, including water soluble salts of organic acids.

In certain particularly preferred embodiments the acid constituent comprises the ternary acid system of formic acid, sulfamic acid and oxalic acid to the exclusion of other organic acids. In still further particularly preferred embodiments the acid constituent comprises the ternary acid system with at least one further co-acid, especially citric acid or lactic acid.

The ternary acid system of formic acid, sulfamic acid and oxalic acid are preferably provided in specific respective weight ratios, wherein the total amount of sulfamic acid is at least equal to or in excess of the total amount of the formic and oxalic acid present. In certain particularly preferred embodiments it is also preferred that oxalic acid is present in at least the following amounts which are indicated in order of increasing preference: 1.5% wt., 1.6% wt., 1.7% wt., 1.75% wt., 1.8% wt., 1.85% wt., 1.9% wt., 1.95% wt., 2.0% wt., 2.02% wt., 2.05% wt., 2.07% wt., 2.075% wt., 2.08% wt., 2.09% wt. and 2.1% wt. In certain embodiments, the components of the ternary acid system are in preferred respective weight ratios of sulfamic acid:formic acid:oxalic acid of 2:0.5-1.5:0.5-1.5, preferably from 2:0.5-1.5:0.75-1.5 with still more preferable weight ratios as described with reference to one or more of the examples disclosed hereinafter.

As inventive compositions are necessarily acidic in nature and exhibit a pH of not more than 3. Preferably the pH of the inventive compositions is between 0.001-2.5, more preferably is between 0.1-2, yet more preferably is between 0.1 and 1.5, and especially preferably is between 0.25 and 1. Certain particularly preferable pHs are demonstrated with reference to one or more of the Examples described hereinafter.

The acid constituent may be present in any effective amount, but desirably is not present in amounts totaling more than about 20% wt. based on the total weight of the compositions. It is to be understood that the nature of the acid or acids selected to form the acid constituent will influence the amount of acid required to obtain a desired final pH or pH range, and the precise amount of acid required for a specific composition can be readily obtained by a skilled artisan utilizing conventional techniques. Further, the amount of acid present in the composition, keeping in mind any optional ingredients that may be present, should be in an amount such that the pH of the composition is about 3 or less, and especially within the preferred pH ranges indicated previously. Generally however, the inclusion of the acid constituent in an amount of from about 1 to 15% wt., more preferably from about 5 to 12% wt. has yielded good results. Particularly preferred acids for use in the acid constituent and particularly preferred amounts thereof are also described with reference to one or more of the Examples.

The inventor have surprisingly found that compositions including the aforesaid ternary acid system are particularly effective in the removal of soap scum stains, limescale and rust stains, however the presence of these acids, and in particular the presence of formic acid imparts a noxious odor to the compositions which discourages their use in consumer products and compositions. However, the inventors have further surprisingly discovered that per careful selection of organic solvents, particularly by careful selection of one or more glycol ethers of the group: phenyl containing glycol ether solvents especially propylene glycol phenyl ether, propylene glycol n-propyl ether and dipropylene glycol n-butyl ether, the noxious odor of the acid constituent, particularly wherein formic acid is present in the acid constituent, can be mitigated. Further, the inclusion of one or more glycol ethers of the aforesaid group has been observed to aid in the soap scum cleaning performance of the compositions within which they are present. Thus, the compositions of the invention necessarily include an organic solvent constituent which comprises at least one glycol ether solvent, preferably a glycol ether solvent which mitigates or masks malodors of at least one of the acids of the ternary acid system, especially formic acid. Thus the inventive compositions necessarily includes one or more glycol ethers of the group: phenyl containing glycol ether solvents especially propylene glycol phenyl ether, propylene glycol n-propyl ether and dipropylene glycol n-butyl ether which may advantageously be present in an amount effective to mitigate the odor of the ternary acid system. In certain particularly preferred embodiments, propylene glycol n-propyl ether is the sole organic solvent constituent present, and especially preferably is the sole organic solvent present in the inventive compositions.

In other preferred embodiments the organic solvent constituent necessarily comprises phenyl containing glycol ether solvents especially propylene glycol phenyl ether, optionally with one or both of propylene glycol n-propyl ether and dipropylene glycol n-butyl ether.

Exemplary useful phenyl containing glycol ether solvents include those which may be represented by the following general structural representation (I):

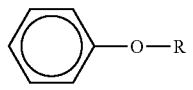

(I)

wherein R is a $C_1$-$C_6$ alkyl group which contains at least one —OH moiety, and preferably R is selected from: $CH_2OH$, $CH_2CH_2OH$, $CH(OH)CH_3$, $CH(OH)CH_2OH$, $CH_2CH_2CH_2OH$, $CH_2CH(OH)CH_3$, $CH(OH)CH_2CH_3$, $CH(OH)CH_2CH_2OH$, $CH(OH)CH(OH)CH_3$, and $CH(OH)CH(OH)CH_2OH$, and the phenyl ring may optionally substituted with one or more further moieties such as $C_1$-$C_3$ alkyl groups but is preferably unsubstituted.

A specific useful phenyl containing glycol ether solvent is commercially supplied as DOWANOL PPH, described to be a propylene glycol phenyl ether which is described by it supplier as being represented by the following structural representation (II):

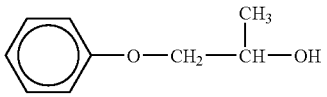

(II)

and further, indicated is that the major isomer is as indicated, which suggests that other alkyl isomers are also present.

The organic solvent constituent may be present in noxious odor mitigating effective amounts. Advantageously the organic solvent constituent is present in amount of from 0.01% wt. to about 10% wt, preferably are present in amounts of from about 0.01-5% wt., and yet more preferably in amounts of from about 0.05-3% wt.

It has surprisingly been observed by the inventors that the inclusion of one or more of one or more glycol ethers of the group: phenyl containing glycol ether solvents especially propylene glycol phenyl ether, propylene glycol n-propyl ether and dipropylene glycol n-butyl ether in the acidic compositions described here, especially particularly when propylene glycol n-propyl ether is present, or is the sole organic solvent present in the compositions, mitigates the noxious odor of the ternary acid system and especially the formic acid constituent. This is particularly true when the acid constituent comprises formic acid. While not wishing to be bound by the following, it is believed that the effect of the foregoing selected glycol ethers, particularly propylene glycol n-propyl ether, acts to diminish or block the trigeminal response of a human subject, viz., a consumer, utilizing the inventive compositions. The trigeminal response of a human subject is a response which is related to but differentiable from a pure olfactory response, and the former is often primarily responsible for sensations of burning, and/or pain when exposed to volatile materials, e.g. volatile organic solvents, perfumes, as well as other chemical compositions and compounds. The inventors have discovered that a meaningful diminishment of the trigeminal response was achieved, particularly in compositions of the invention which comprised both propylene glycol n-propyl ether and formic acid, and especially when the compositions are aerosolized or sprayed from a container. It is therefore believed that these specific group of glycol ethers, especially propylene glycol n-propyl ether, may thus also be included in other hard surface cleaning and/or disinfecting compositions in amounts effective to diminish or block the trigeminal response of a human subject to one or more acids present in the composition. Such an effect may be ascertained by comparison to like compositions which however incorporate a glycol ether or other organic solvent exclusive of glycol ethers of the group: phenyl containing glycol ether solvents especially propylene glycol phenyl ether, propylene glycol n-propyl ether and dipropylene glycol n-butyl ether.

In addition to the essential organic solvent constituent discussed above, the inventive compositions may optionally include one or more further organic solvents as a co-solvent constituent. Exemplary useful organic solvents which may be present in the inventive compositions as co-solvents include those which are at least partially water-miscible such as alcohols (e.g., low molecular weight alcohols, such as, for example, ethanol, propanol, isopropanol, and the like), glycols (such as, for example, ethylene glycol, propylene glycol, hexylene glycol, and the like), water-miscible ethers (e.g. diethylene glycol diethylether, diethylene glycol dimethylether, propylene glycol dimethylether), water-miscible glycol ether (e.g. propylene glycol monomethylether, propylene glycol mono ethylether, propylene glycol monopropylether, propylene glycol monobutylether, ethylene glycol monobutylether, dipropylene glycol monomethylether, diethyleneglycol monobutylether), lower esters of monoalkylethers of ethylene glycol or propylene glycol (e.g. propylene glycol monomethyl ether acetate), and mixtures thereof. Glycol ethers having the general structure Ra—Rb—OH, wherein Ra is an alkoxy of 1 to 20 carbon atoms, or aryloxy of at least 6 carbon atoms, and Rb is an ether condensate of propylene glycol and/or ethylene glycol having from one to ten glycol monomer units. Mixtures of two or more specific organic solvents may be used, or alternately a single organic solvent may be provided as the organic solvent constituent.

When present, such optional organic co-solvent(s) may be present in amounts of up to about 10% wt, preferably are present in amounts of from about 0.01-7.5% wt., still more preferably from about 0.1-5% wt. As stated previously however, in certain particularly preferred embodiments, the organic co-solvents are excluded from the inventive compositions.

The compositions of the invention necessarily comprise a nonionic surfactant which are monobranched alkoxylated C10-fatty alcohols and/or C11-fatty alcohols; these are jointly referred to as C10/C11-fatty alcohols. These materials are nonionic surfactants are monobranched and may have various degrees of alkoxylation, and are typically ethoxylated with between about 3 and 14 moles of ethylene oxide, typically 4, 5, 6, 7, 8, 9, 10 or 14 moles ethylene oxide. Such nonionic surfactants are presently commercially available under the Lutensol® (ex. BASF AG) and are available in a variety of grades e.g., Lutensol® XL 40 recited by its supplier to be a C10-Guerbet alcohol which is approximately 4 moles of ethoxylation, Lutensol® XL 50 recited by its supplier to be a C10-Guerbet alcohol which is approximately 5 moles of ethoxylation, Lutensol® XL 60 recited by its supplier to be a C10-Guerbet alcohol which is approximately 6 moles of ethoxylation, Lutensol® XL 70 recited by its supplier to be a C10-Guerbet alcohol which is approximately 7 moles of ethoxylation, Lutensol® XL 40 recited by its supplier to be a C10-Guerbet alcohol which is approximately 4 moles of ethoxylation, Lutensol® XL 79 recited by its supplier to be a C10-Guerbet alcohol which is approximately 7 moles of ethoxylation, Lutensol® XL 80 recited by its supplier to be a C10-Guerbet alcohol which is approximately 8 moles of ethoxylation, Lutensol® XL 89 recited by its supplier to be a C10-Guerbet alcohol which is approximately 8 moles of ethoxylation, Lutensol® XL 90 recited by its supplier to be a C10-Guerbet alcohol which is approximately 9 moles of ethoxylation, Lutensol® XL 99 recited by its supplier to be a C10-Guerbet alcohol which is approximately 9 moles of ethoxylation, Lutensol® XL 100 recited by its supplier to be a C10-Guerbet alcohol which is approximately 10 moles of ethoxylation, Lutensol® XL 140 recited by its supplier to be a C10-Guerbet alcohol which is approximately 14 moles of ethoxylation, all available from BASF AG. Alternately or additionally, nonionic surfactant based on monobranched alkoxylated C10-fatty alcohols marketed under the Lutensol® XP series of surfactants, also ex. BASF AG, may also be used. While the foregoing materials are ethoxylated, it is to be understood that other alkoxylated, e.g., propoxylated, butoxylated, as well as mixed ethoxylated and propoxylated branched nonionic alkyl polyethylene glycol ether may also be used. It is contemplated by the inventors that similar nonionic surfactants based on monobranched alkoxylated C11-fatty alcohols may be used to substitute part of, or all of the nonionic surfactant based on monobranched alkoxylated C10-fatty alcohols. These include for example, the Genapol® UD series described as tradenames Genapol® UD 030, $C_{11}$-oxo-alcohol polyglycol ether with 3 EO; Genapol® UD, 050 $C_{11}$-oxo-alcohol polyglycol ether with 5 EO; Genapol® UD 070, $C_{11}$-oxo-alcohol polyglycol ether with 7 EO; Genapol® UD 080, $C_{11}$-oxo-alcohol polyglycol ether with 8 EO; Genapol® UD 088, $C_{11}$-oxo-alcohol polyglycol ether with 8 EO; and Genapol® UD 110, $C_{11}$-oxo-alcohol polyglycol ether with 11 EO (ex. Clariant).

The nonionic surfactant based on monobranched alkoxylated C10/C11-fatty alcohols (and/or C11-fatty alcohols) is necessarily present in the hard surface cleaning compositions in amount of from 0.01-5% wt., preferably in amount of from 1-3% wt., yet more preferably from 1-2.5% wt. based on the total weight of the hard surface cleaning composition of which it forms a part.

The hard surface cleaning compositions of the invention optionally but in some cases desirably comprise at least one co-surfacant constituent. Such a co-surfactant may be one or more surfactants selected from one or more further anionic, nonionic, cationic, amphoteric or zwitterionic surfactants;

Exemplary of anionic surfactants which may be present include alcohol sulfates and sulfonates, alcohol phosphates and phosphonates, alkyl ester sulfates, alkyl diphenyl ether sulfonates, alkyl sulfates, alkyl ether sulfates, sulfate esters of an alkylphenoxy polyoxyethylene ethanol, alkyl monoglyceride sulfates, alkyl sulfonates, alkyl ether sulfates, alpha-olefin sulfonates, beta-alkoxy alkane sulfonates, alkyl ether sulfonates, ethoxylated alkyl sulfonates, alkylaryl sulfonates, alkylaryl sulfates, alkyl monoglyceride sulfonates, alkyl carboxylates, alkyl ether carboxylates, alkyl alkoxy carboxylates having 1 to 5 moles of ethylene oxide, alkylpolyglycolethersulfates (containing up to 10 moles of ethylene oxide), sulfosuccinates, octoxynol or nonoxynol phosphates, taurates, fatty taurides, fatty acid amide polyoxyethylene sulfates, acyl glycerol sulfonates, fatty oleyl glycerol sulfates, alkyl phenol ethylene oxide ether sulfates, paraffin sulfonates, alkyl phosphates, isethionates, N-acyl taurates, alkyl succinamates and sulfosuccinates, alkylpolysaccharide sulfates, alkylpolyglucoside sulfates, alkyl polyethoxy carboxylates, and sarcosinates or mixtures thereof. These anionic surfactants may be provided as salts with one or more organic counterions, e.g., ammonium, or inorganic counteraions, especially as salts of one or more alkaline earth or alkaline earth metals, e.g., sodium.

Further examples of anionic surfactants include water soluble salts or acids of the formula $(ROSO_3)M$ or $(RSO_3)M$ wherein R is preferably a $C_6$-$C_{24}$ hydrocarbyl, preferably an alkyl or hydroxyalkyl having a $C_{10}$-$C_{20}$ alkyl component, more preferably a $C_{12}$-$C_{18}$ alkyl or hydroxyalkyl, and M is H or a mono-, di- or tri-valent cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like) and x is an integer, preferably 1 to 3, most preferably 1. Materials sold under the Hostapur and Biosoft trademarks are examples of such anionic surfactants.

Still further examples of anionic surfactants include alkyl-diphenyl-ethersulphonates and alkyl-carboxylates.

Also useful as anionic surfactants are diphenyl disulfonates, and salt forms thereof, such as a sodium salt of diphenyl disulfonate commercially available as Dowfax® 3B2. Such diphenyl disulfonates are included in certain preferred embodiments of the invention in that they provide not only a useful cleaning benefit but concurrently also provide a useful degree of hydrotropic functionality.

Other anionic surfactants can include salts (including, for example, sodium, potassium, ammonium, and substituted ammonium salts such as mono-, di- and triethanolamine salts) of soap, $C_6$-$C_{20}$ linear alkylbenzenesulfonates, $C_6$-$C_{22}$ primary or secondary alkanesulfonates, $C_6$-$C_{24}$ olefinsulfonates, sulfonated polycarboxylic acids prepared by sulfonation of the pyrolyzed product of alkaline earth metal citrates, $C_6$-$C_{24}$ alkylpolyglycolethersulfates, alkyl ester sulfates such as $C_{14-16}$ methyl ester sulfates; acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12}$-$C_{18}$ monoesters) diesters of sulfosuccinate (especially saturated and unsaturated $C_6$-$C_{14}$ diesters), acyl sarcosinates, sulfates of alkylpolysaccharides such as the sulfates of alkylpolyglucoside, branched primary alkyl sulfates, alkyl polyethoxy carboxylates such as those of the formula $RO(CH_2CH_2O)_kCH_2COO^-M^+$ wherein R is a $C_8$-$C_{22}$ alkyl, k is an integer from 0 to 10, and M is a soluble salt-forming cation. Examples of the foregoing anionic surfactants are available under the following tradenames: Rhodapon®, Stepanol®, Hostapur®, Surfine®, Sandopan®, Neodox®, Biosoft®, and Avanel®.

An anionic surfactant compound which may be particularly useful in the inventive compositions when the compositions are at a pH of 2 or less are one or more anionic surfactants based on alphasulphoesters including one or more salts thereof. Such particularly preferred anionic surfactants may be represented by the following general structures:

(A)

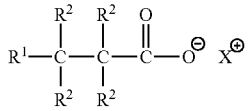

(B)

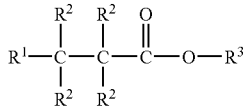

wherein, in each of the foregoing:

$R^1$ represents a $C_6$-$C_{22}$ alkyl or alkenyl group;

each of $R^2$ is either hydrogen, or if not hydrogen is a $SO_3^-$ having associated with it a cation, $X^+$, which renders the compound water soluble or water dispersible, with X preferably being an alkali metal or alkaline earth metal especially sodium or potassium, especially sodium, with the proviso that at least one $R^2$, preferably at least two $R^2$ is a $(SO_3^-)$ having an associated cation $X^+$, and, $R^3$ represents a $C_1$-$C_6$, preferably $C_1$-$C_4$ lower alkyl or alkenyl group, especially methyl.

According to certain preferred embodiments, anionic surfactants are however expressly excluded from the compositions of the present invention.

One class of exemplary useful nonionic surfactants are polyethylene oxide condensates of alkyl phenols. These compounds include the condensation products of alkyl phenols having an alkyl group containing from about 6 to 12 carbon atoms in either a straight chain or branched chain configuration with ethylene oxide, the ethylene oxide being present in an amount equal to 5 to 25 moles of ethylene oxide per mole of alkyl phenol. The alkyl substituent in such compounds can be derived, for example, from polymerized propylene, diisobutylene and the like. Examples of compounds of this type include nonyl phenol condensed with about 9.5 moles of ethylene oxide per mole of nonyl phenol; dodecylphenol condensed with about 12 moles of ethylene oxide per mole of phenol; dinonyl phenol condensed with about 15 moles of ethylene oxide per mole of phenol and diisooctyl phenol condensed with about 15 moles of ethylene oxide per mole of phenol.

Further useful nonionic surfactants include the condensation products of aliphatic alcohols with from about 1 to about 60 moles of ethylene oxide. The alkyl chain of the aliphatic alcohol can either be straight or branched, primary or secondary, and generally contains from about 8 to about 22 carbon atoms. Examples of such ethoxylated alcohols include the condensation product of myristyl alcohol condensed with about 10 moles of ethylene oxide per mole of alcohol and the condensation product of about 9 moles of ethylene oxide with coconut alcohol (a mixture of fatty alcohols with alkyl chains varying in length from about 10 to 14 carbon atoms). Other examples are those $C_6$-$C_{11}$ straight-chain alcohols which are ethoxylated with from about 3 to about 6 moles of ethylene oxide. Their derivation is well known in the art. Examples include Alfonic® 810-4.5 (also available as Teric G9A5), which is described in product literature from Sasol as a $C_{8-10}$ having an average molecular weight of 356, an ethylene oxide content of about 4.85 moles (about 60 wt. %), and an HLB of about 12; Alfonic® 810-2, which is described in product literature from Sasol as a $C_{8-10}$ having an average molecular weight of 242, an ethylene oxide content of about 2.1 moles (about 40 wt. %), and an HLB of about 12; and Alfonic® 610-3.5, which is described in product literature from Sasol as having an average molecular weight of 276, an ethylene oxide content of about 3.1 moles (about 50 wt. %), and an HLB of 10. Product literature from Sasol also identifies that the numbers in the alcohol ethoxylate name designate the carbon chain length (numbers before the hyphen) and the average moles of ethylene oxide (numbers after the hyphen) in the product.

Further exemplary useful nonionic surfactants include ethoxylated available from Shell Chemical Company which are described as $C_9$-$C_{11}$ ethoxylated alcohols and marketed under the Neodol® tradename. The Neodol® 91 series nonionic surfactants of interest include Neodol 91-2.5, Neodol 91-6, and Neodol 91-8. Neodol 91-2.5 has been described as having about 2.5 ethoxy groups per molecule; Neodol 91-6 has been described as having about 6 ethoxy groups per molecule; and Neodol 91-8 has been described as having about 8 ethoxy groups per molecule. Still further examples of ethoxylated alcohols include the Rhodasurf® DA series nonionic surfactants available from Rhodia which are described to be branched isodecyl alcohol ethoxylates. Rhodasurf DA-530 has been described as having 4 moles of ethoxylation and an HLB of 10.5; Rhodasurf DA-630 has been described as having 6 moles of ethoxylation with an HLB of 12.5; and Rhodasurf DA-639 is a 90% solution of DA-630.

Further examples of ethoxylated alcohols include those from Tomah Products (Milton, Wis.) under the Tomadol tradename with the formula $RO(CH_2CH_2O)_nH$ where R is the primary linear alcohol and n is the total number of moles of ethylene oxide. The ethoxylated alcohol series from Tomah include 91-2.5; 91-6; 91-8—where R is linear C9/C10/C11 and n is 2.5, 6, or 8; 1-3; 1-5; 1-7; 1-73B; 1-9; —where R is linear C11 and n is 3, 5, 7 or 9; 23-1; 23-3; 23-5; 23-6.5—where R is linear C12/C13 and n is 1, 3, 5, or 6.5; 25-3; 25-7; 25-9; 25-12—where R is linear C12/C13 C14/C15 and n is 3, 7, 9, or 12; and 45-7; 45-13—where R is linear C14/C15 and n is 7 or 13.

Other examples of useful nonionic surfactants include those having a formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from about 1 to about 12. Surfactants of this formula are presently marketed under the Genapol® tradename. available from Clariant, Charlotte, N.C., include the 26-L series of the general formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from 1 to about 12, such as 26-L-1,26-L-1.6, 26-L-2,26-L-3,26-L-5,26-L-45, 26-L-50, 26-L-60, 26-L-60N, 26-L-75, 26-L-80, 26-L-98N, and the 24-L series, derived from synthetic sources and typically contain about 55% $C_{12}$ and 45% $C_{14}$ alcohols, such as 24-L-3,24-L-45, 24-L-50, 24-L-60, 24-L-60N, 24-L-75, 24-L-92, and 24-L-98N. From product literature, the single number following the "L" corresponds to the average degree of ethoxylation (numbers between 1 and 5) and the two digit number following the letter "L" corresponds to the cloud point in ° C. of a 1.0 wt. % solution in water.

A further class of nonionic surfactants which are contemplated to be useful include those based on alkoxy block copolymers, and in particular, compounds based on ethoxy/propoxy block copolymers. Polymeric alkylene oxide block copolymers include nonionic surfactants in which the major portion of the molecule is made up of block polymeric $C_2$-$C_4$ alkylene oxides. Such nonionic surfactants, while preferably built up from an alkylene oxide chain starting group, and can have as a starting nucleus almost any active hydrogen containing group including, without limitation, amides, phenols, thiols and secondary alcohols.

One group of such useful nonionic surfactants containing the characteristic alkylene oxide blocks are those which may be generally represented by the formula (A):

$$HO\text{-}(EO)_x(PO)_y\text{-}(EO)_z\text{—}H \quad (A)$$

where EO represents ethylene oxide,

PO represents propylene oxide, y equals at least 15, $(EO)_{x+y}$ equals 20 to 50% of the total weight of said compounds, and, the total molecular weight is preferably in the range of about 2000 to 15,000. These surfactants are available under the PLURONIC tradename from BASF or Emulgen from Kao.

Another group of nonionic surfactants appropriate for use in the new compositions can be represented by the formula (B):

$$R\text{-}(EO,PO)_a(EO,PO)_b\text{—}H \quad (B)$$

wherein R is an alkyl, aryl or aralkyl group, where the R group contains 1 to 20 carbon atoms, the weight percent of EO is within the range of 0 to 45% in one of the blocks a, b, and within the range of 60 to 100% in the other of the blocks a, b, and the total number of moles of combined EO and PO is in the range of 6 to 125 moles, with 1 to 50 moles in the PO rich block and 5 to 100 moles in the EO rich block.

Further nonionic surfactants which in general are encompassed by Formula B include butoxy derivatives of propylene oxide/ethylene oxide block polymers having molecular weights within the range of about 2000-5000.

Still further useful nonionic surfactants containing polymeric butoxy (BO) groups can be represented by formula (C) as follows:

$$RO—(BO)_n(EO)_x—H \quad (C)$$

wherein R is an alkyl group containing I to 20 carbon atoms, n is about 5-15 and x is about 5-15.

Also useful as the nonionic block copolymer surfactants, which also include polymeric butoxy groups, are those which may be represented by the following formula (D):

$$HO\text{-}(EO)_x(BO)_n(EO)_y—H \quad (D)$$

wherein n is about 5-15, preferably about 15, x is about 5-15, preferably about 15, and y is about 5-15, preferably about 15.

Still further useful nonionic block copolymer surfactants include ethoxylated derivatives of propoxylated ethylene diamine, which may be represented by the following formula:

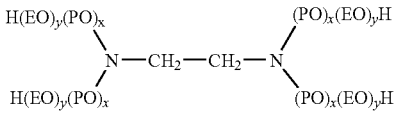

(E)

where (EO) represents ethoxy, (PO) represents propoxy, the amount of $(PO)_x$ is such as to provide a molecular weight prior to ethoxylation of about 300 to 7500, and the amount of $(EO)_y$ is such as to provide about 20% to 90% of the total weight of said compound.

Surfactants based on amine oxides are also contemplated to be useful in the cosurfactant constituent in the present inventive compositions. Exemplary amine oxides include:

alkyl di($C_1$-$C_7$) amine oxides in which the alkyl group has about 10-20, and preferably 12-16 carbon atoms, and can be straight or branched chain, saturated or unsaturated. Examples of such compounds include lauryl dimethyl amine oxide, myristyl dimethyl amine oxide, and those in which the alkyl group is a mixture of different amine oxide, dimethyl cocoamine oxide, dimethyl (hydrogenated tallow) amine oxide, and myristyl/palmityl dimethyl amine oxide;

alkyl di(hydroxy $C_1$-$C_7$) amine oxides in which the alkyl group has about 10-20, and preferably 12-16 carbon atoms, and can be straight or branched chain, saturated or unsaturated. Examples of such compounds include bis(2-hydroxyethyl) cocoamine oxide, bis(2-hydroxyethyl) tallowamine oxide; and bis(2-hydroxyethyl) stearylamine oxide;

alkylamidopropyl di($C_1$-$C_7$) amine oxides in which the alkyl group has about 10-20, and preferably 12-16 carbon atoms, and can be straight or branched chain, saturated or unsaturated. Examples of such compounds include cocoamidopropyl dimethyl amine oxide and tallowamidopropyl dimethyl amine oxide; and alkylmorpholine oxides in which the alkyl group has about 10-20, and preferably 12-16 carbon atoms, and can be straight or branched chain, saturated or unsaturated.

By way of non-limiting example exemplary amphoteric surfactants which are contemplated to be useful in the cosurfactant constituent include one or more water-soluble betaine surfactants which may be represented by the general formula:

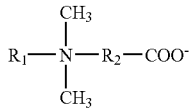

wherein $R_1$ is an alkyl group containing from 8 to 18 carbon atoms, or the amido radical which may be represented by the following general formula:

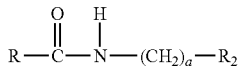

wherein R is an alkyl group having from 8 to 18 carbon atoms, a is an integer having a value of from 1 to 4 inclusive, and $R_2$ is a $C_1$-$C_4$ alkylene group. Examples of such water-soluble betaine surfactants include dodecyl dimethyl betaine, as well as cocoamidopropylbetaine.

A cosurfactant which is desirably present according to certain preferred embodiments of the invention is an alkylpolyglucoside which is to be understood as including alkylmonoglucosides and alkylpolyglucosides surfactant based on a polysaccharide, which are preferably one or more alkyl polyglucosides. These materials may also be referred to as alkyl monoglucosides and alkylpolyglucosides. Suitable alkyl polyglucosides are known nonionic surfactants which are alkaline and electrolyte stable. Such include alkyl glucosides, alkyl polyglucosides and mixtures thereof. Alkyl glucosides and alkyl polyglucosides can be broadly defined as condensation articles of long chain alcohols, e.g., $C_8$-$C_{30}$ alcohols, with sugars or starches or sugar or starch polymers i.e., glucosides or polyglucosides. These compounds can be represented by the formula $(S)_n$—O—R wherein S is a sugar moiety such as glucose, fructose, mannose, and galactose; n is an integer of from about 1 to about 1000, and R is a $C_{8-30}$ alkyl group. Examples of long chain alcohols from which the alkyl group can be derived include decyl alcohol, cetyl alcohol, stearyl alcohol, lauryl alcohol, myristyl alcohol, oleyl alcohol and the like.

Alkyl mono- and polyglucosides are prepared generally by reacting a monosaccharide, or a compound hydrolyzable to a monosaccharide with an alcohol such as a fatty alcohol in an acid medium. Various glucoside and polyglucoside compounds including alkoxylated glucosides and processes for making them are disclosed in U.S. Pat. Nos. 2,974,134; 3,219,656; 3,598,865; 3,640,998; 3,707,535; 3,772,269; 3,839,318; 3,974,138; 4,223,129; and 4,528,106.

Exemplary useful alkyl glucoside surfactants suitable for use in the practice of this invention may be represented by formula I below:

$$RO—(R_1O)_y\text{-}(G)_xZ_b \quad I$$

wherein:

R is a monovalent organic radical containing from about 6 to about 30, preferably from about 8 to about 18 carbon atoms;

$R_1$ is a divalent hydrocarbon radical containing from about 2 to about 4 carbon atoms;

O is an oxygen atom;

y is a number which has an average value from about 0 to about 1 and is preferably 0;

G is a moiety derived from a reducing saccharide containing 5 or 6 carbon atoms; and x is a number having an average value from about 1 to 5 (preferably from 1.1 to 2);

Z is $O_2M^1$,

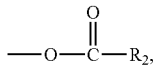

$O(CH_2)$, $CO_2M^1$, $OSO_3M^1$, or $O(CH_2)SO_3M^1$; $R_2$ is $(CH_2)CO_2M^1$ or $CH{=}CHCO_2M^1$; (with the proviso that Z can be $O_2M^1$ only if Z is in place of a primary hydroxyl group in which the primary hydroxyl-bearing carbon atom, $—CH_2OH$, is oxidized to form a

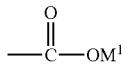

group);

b is a number of from 0 to 3x+1 preferably an average of from 0.5 to 2 per glycosal group;

p is 1 to 10, $M^1$ is $H^+$ or an organic or inorganic cation, such as, for example, an alkali metal, ammonium, monoethanolamine, or calcium.

As defined in Formula I above, R is generally the residue of a fatty alcohol having from about 8 to 30 and preferably 8 to 18 carbon atoms.

Further exemplary useful alkylpolyglucosides include those according to the formula II:

$$R_2O—(C_nH_{2n}O)_r—(Z)_x \qquad \text{II}$$

wherein:

$R_2$ is a hydrophobic group selected from alkyl groups, alkylphenyl groups, hydroxyalkylphenyl groups as well as mixtures thereof, wherein the alkyl groups may be straight chained or branched, and which contain from about 8 to about 18 carbon atoms, n has a value of 2-8, especially a value of 2 or 3; r is an integer from 0 to 10, but is preferably 0, Z is derived from glucose; and, x is a value from about 1 to 8, preferably from about 1.5 to 5.

Preferably the alkylpolyglucosides are nonionic fatty alkylpolyglucosides which contain a straight chain or branched chain $C_8$-$C_{15}$ alkyl group, and have an average of from about 1 to 5 glucose units per fatty alkylpolyglucoside molecule. More preferably, the nonionic fatty alkylpolyglucosides which contain straight chain or branched $C_8$-$C_{15}$ alkyl group, and have an average of from about 1 to about 2 glucose units per fatty alkylpolyglucoside molecule.

Examples of such alkylpolyglucosides as described above include, for example, APG™ 325 which is described as being a $C_9$-$C_{11}$ alkyl polyglucoside, also commonly referred to as D-glucopyranoside, (ex. Cognis). Further exemplary alkylpolyglucosides include Glucopon® 625 CS which is described as being a $C_{10}$-$C_{16}$ alkyl polyglucoside, also commonly referred to as a D-glucopyranoside, (ex. Cognis), lauryl polyglucoside available as APG™ 600 CS and 625 CS (ex. Cognis) as well as other materials sold under the Glucopon® tradename, e.g., Glucopon® 215, Glucopon® 225, Glucopon® 425, especially one or more of the alkyl polyglucosides demonstrated in one or more of the examples. It is believed that the alkylpolyglucoside surfactants sold under the Glucopon® tradename are synthesized at least in part on synthetically produced starting constituents and are colorless or only slightly colored, while those sold under the APG™ are synthesized at least in part on naturally occurring or sourced starting constituents and are more colored in appearance.

In certain preferred embodiments however, the nonionic monobranched alkoxylated C10/C11-fatty alcohols are present with one or more nonionic cosurfactants preferably to the exclusion of further non-nonionic surfactants particularly cationic, amphoteric or zwitterionic surfactants.

When present, any cosurfactant(s) may be present in any cleaning effective amounts up to about 5% wt, preferably are present in amounts of from about 0.01-2.5% wt., yet more preferably from about 0.01-2% wt., based on the total weight of the composition of which it forms a part.

The inventive compositions may optionally include one or more one or more further constituents useful in improving one or more aesthetic characteristics or the compositions or in improving one or more technical characteristics of the compositions. Exemplary further optional constituents include coloring agents, fragrances and fragrance solubilizers, viscosity modifying agents including one or more thickeners, pH adjusting agents and pH buffers including organic and inorganic salts, optical brighteners, opacifying agents, hydrotropes, abrasives, and preservatives, as well as other optional constituents providing improved technical or aesthetic characteristics known to the relevant art. When present, the total amount of such one or more optional constituents present in the inventive compositions do not exceed about 10% wt., preferably do not exceed 2.5% wt., and most preferably do not exceed 1.5% wt.

By way of non-limiting example pH adjusting agents include phosphorus containing compounds, monovalent and polyvalent salts such as of silicates, carbonates, and borates, certain acids and bases, tartrates and certain acetates. Further exemplary pH adjusting agents include mineral acids, basic compositions, and organic acids, which are typically required in only minor amounts. By way of further non-limiting example pH buffering compositions include the alkali metal phosphates, polyphosphates, pyrophosphates, triphosphates, tetraphosphates, silicates, metasilicates, polysilicates, carbonates, hydroxides, and mixtures of the same. Certain salts, such as the alkaline earth phosphates, carbonates, hydroxides, can also function as buffers. It may also be suitable to use as buffers such materials as aluminosilicates (zeolites), borates, aluminates and certain organic materials such as gluconates, succinates, maleates, and their alkali metal salts. When present, the pH adjusting agent, especially the pH buffers are present in an amount effective in order to maintain the pH of the inventive composition within a target pH range.

The inventive compositions may include one or more coloring agents which may be included to impart a desired color or tint to the compositions.

The compositions of the invention optionally but in certain cases desirably include a fragrance constituent. Fragrance raw materials may be divided into three main groups: (1) the essential oils and products isolated from these oils; (2) products of animal origin; and (3) synthetic chemicals.

The essential oils consist of complex mixtures of volatile liquid and solid chemicals found in various parts of plants. Mention may be made of oils found in flowers, e.g., jasmine, rose, mimosa, and orange blossom; flowers and leaves, e.g., lavender and rosemary; leaves and stems, e.g., geranium, patchouli, and petitgrain; barks, e.g., cinnamon; woods, e.g., sandalwood and rosewood; roots, e.g., angelica; rhizomes, e.g., ginger; fruits, e.g., orange, lemon, and bergamot; seeds, e.g., aniseed and nutmeg; and resinous exudations, e.g., myrrh. These essential oils consist of a complex mixture of chemicals, the major portion thereof being terpenes, including hydrocarbons of the formula $(C_5H_8)_n$ and their oxygenated derivatives. Hydrocarbons such as these give rise to a large number of oxygenated derivatives, e.g., alcohols and their esters, aldehydes and ketones. Some of the more important of these are geraniol, citronellol and terpineol, citral and citronellal, and camphor. Other constituents include aliphatic aldehydes and also aromatic compounds including phenols such as eugenol. In some instances, specific compounds may be isolated from the essential oils, usually by distillation in a commercially pure state, for example, geraniol and citronellal from citronella oil; citral from lemon-grass oil; eugenol from clove oil; linalool from rosewood oil; and safrole from sassafras oil. The natural isolates may also be chemically modified as in the case of citronellal to hydroxy citronellal, citral to ionone, eugenol to vanillin, linalool to linalyl acetate, and safrol to heliotropin.

Animal products used in perfumes include musk, ambergris, civet and castoreum, and are generally provided as alcoholic tinctures.

The synthetic chemicals include not only the synthetically made, also naturally occurring isolates mentioned above, but also include their derivatives and compounds unknown in nature, e.g., isoamylsalicylate, amylcinnamic aldehyde, cyclamen aldehyde, heliotropin, ionone, phenylethyl alcohol, terpineol, undecalactone, and gamma nonyl lactone.

Fragrance compositions as received from a supplier may be provided as an aqueous or organically solvated composition, and may include as a hydrotrope or emulsifier a surface-active agent, typically a surfactant, in minor amount. Such fragrance compositions are quite usually proprietary blends of many different specific fragrance compounds. However, one of ordinary skill in the art, by routine experimentation, may easily determine whether such a proprietary fragrance composition is compatible in the compositions of the present invention.

One or more coloring agents may also be used in the inventive compositions in order to impart a desired colored appearance or colored tint to the compositions. Known art water soluble or water dispersible pigments and dyes may be added in effective amounts.

The inventive compositions may include a hydrotrope constituent comprising one or more compounds which exhibit a hydrotropic functionality in the inventive compositions. Exemplary hydrotropes include, inter alia, benzene sulfonates, naphthalene sulfonates, $C_1$-$C_{1i}$ alkyl benzene sulfonates, naphthalene sulfonates, $C_5$-$C_{11}$ alkyl sulfonates, $C_6$-$C_{11}$ alkyl sulfates, alkyl diphenyloxide disulfonates, and phosphate ester hydrotropes. The hydrotropic compounds of the invention are often provided in a salt form with a suitable counterion, such as one or more alkali, or alkali earth metals, such as sodium or potassium, especially sodium. However, other water soluble cations such as ammonium, mono-, di- and tri-lower alkyl, i.e., $C_{1-4}$ alkanol ammonium groups can be used in the place of the alkali metal cations. Exemplary alkyl benzene sulfonates include, for example, isopropylbenzene sulfonates, xylene sulfonates, toluene sulfonates, cumene sulfonates, as well as mixtures thereof. Exemplary $C_5$-$C_{11}$ alkyl sulfonates include hexyl sulfonates, octyl sulfonates, and hexyl/octyl sulfonates, and mixtures thereof. Particularly useful hydrotrope compounds include benzene sulfonates, o-toluene sulfonates, m-toluene sulfonates, and p-toluene sulfonates; 2,3-xylene sulfonates, 2,4-xylene sulfonates, and 4,6-xylene sulfonates; cumene sulfonates, wherein such exemplary hydrotropes are generally in a salt form thereof, including sodium and potassium salt forms. When present the hydrotrope constituent may be present in any effective amounts, or they may be omitted. Advantageously, when present, the hydrotrope constituent comprises 0.001-1% wt. of the composition of which it forms a part.

A further optional constituent are one or more preservatives. Such preservatives are primarily included to reduce the growth of undesired microorganisms within the composition during storage prior to use. Exemplary useful preservatives include compositions which include parabens, including methyl parabens and ethyl parabens, glutaraldehyde, formaldehyde, 2-bromo-2-nitropropoane-1,3-diol, 5-chloro-2-methyl-4-isothiazolin-3-one, 2-methyl-4-isothiazoline-3-one, and mixtures thereof. One exemplary composition is a combination 5-chloro-2-methyl-4-isothiazolin-3-one and 2-methyl-4-isothiazolin-3-one where the amount of either component may be present in the mixture anywhere from 0.001 to 99.99 weight percent, based on the total amount of the preservative. Further exemplary useful preservatives include those which are commercially including a mixture of 5-chloro-2-methyl-4-isothiazolin-3-one and 2-methyl-4-isothiazolin-3-one marketed under the trademark KATHON® CG/ICP as a preservative composition presently commercially available from Rohm and Haas (Philadelphia, Pa.). Further useful and commercially available preservative compositions include KATHON® CG/ICP II, a further preservative composition presently commercially available from Rohm and Haas (Philadelphia, Pa.), PROXEL® which is presently commercially available from Zeneca Biocides (Wilmington, Del.), SUTTOCIDE® A which is presently commercially available from Sutton Laboratories (Chatam, N.J.) as well as TEXTAMER® 38AD which is presently commercially available from Calgon Corp. (Pittsburgh, Pa.).

Optionally one or more abrasives may be included in the inventive compositions. Exemplary abrasives include: oxides, e.g., calcined aluminum oxides and the like, carbonates, e.g., calcium carbonate and the like, quartzes, siliceous chalk, diatomaceous earth, colloidal silicon dioxide, alkali metasilicates, e.g., sodium metasilicate and the like, perlite, pumice, feldspar, calcium phosphate, organic abrasive materials based on comminuted or particulate polymers especially one or more of polyolefins, polyethylenes, polypropylenes, polyesters, polystyrenes, acetonitrile-butadiene-styrene resins, melamines, polycarbonates, phenolic resins, epoxies and polyurethanes, natural materials such as, for example, rice hulls, corn cobs, and the like, or talc and mixtures thereof. The particle size of the abrasive agent typically may range from about 1 μm to about 1000 μm, preferably between about 10 μm to about 200 μm, and more preferably between about 10 μm and about 100 μm. It is preferred to us those abrasive agents that will not scratch most hard surfaces. Such abrasive agents include calcium carbonate, siliceous chalk, diatomaceous earth, colloidal silicon dioxide, sodium metasilicate, talc, and organic abrasive materials. Calcium carbonate is preferred as being effective and available at a generally low cost. A single type of abrasive, or a mixture of two or more differing abrasive materials may be used.

Optionally the compositions may include an effective amount of at least one water soluble inorganic salt, which may be present in any amount which is found to provide some technical improvement to the compositions of which they form a part. For purposes of the present invention, "water-soluble" means having a solubility in water of at least 10 grams per hundred grams of water at 20° C. Examples of suitable salts include various alkali metal and/or alkaline earth metal chlorides including sodium chloride, calcium chloride, magnesium chloride and zinc chloride. Particularly preferred are sodium chloride and calcium chloride which have been surprisingly observed to provide excellent metal cleaning efficacy particularly of aged copper surfaces. When present such water soluble inorganic salts may be presend in amounts of from about 0.00001 to about 2.5% by weight, desirably in amounts of 0.001 to about 2% by weight, yet more desirably from about 0.01 to about 1.5% by weight and most desirably from about 0.2 to about 1.5% weight. It is to be noted however, that in certain preferred embodiments such water soluble inorganic salts may deleteriously affect the cleaning performance of certain stains, such as soap scum and rust cleaning as the presence of such water soluble inorganic salts may release ions which would interfere with the ability of oxalic acid and/or formic acid to provide a good cleaning benefit. Thus in certain preferred embodiments, such water soluble inorganic salts are excluded from compositions according to the invention.

The inventive compositions may include a thickener constituent which may be added in any effective amount in order to increase the viscosity of the compositions. Exemplary thickeners useful in the thickener constituent include one or more of polysaccharide polymers selected from cellulose, alkyl celluloses, alkoxy celluloses, hydroxy alkyl celluloses, alkyl hydroxy alkyl celluloses, carboxy alkyl celluloses, carboxy alkyl hydroxy alkyl celluloses, naturally occurring polysaccharide polymers such as xanthan gum, guar gum, locust bean gum, tragacanth gum, or derivatives thereof, polycarboxylate polymers, polyacrylamides, clays, and mixtures thereof.

Examples of the cellulose derivatives include methyl cellulose ethyl cellulose, hydroxymethyl cellulose hydroxy ethyl cellulose, hydroxy propyl cellulose, carboxy methyl cellulose, carboxy methyl hydroxyethyl cellulose, hydroxypropyl cellulose, hydroxy propyl methyl cellulose, ethylhydroxymethyl cellulose and ethyl hydroxy ethyl cellulose.

Exemplary polycarboxylate polymers thickeners have a molecular weight from about 500,000 to about 4,000,000, preferably from about 1,000,000 to about 4,000,000, with, preferably, from about 0.5% to about 4% crosslinking. Preferred polycarboxylate polymers include polyacrylate polymers including those sold under trade names Carbopol®, Acrysol® ICS-1 and Sokalan®. The preferred polymers are polyacrylates. Other monomers besides acrylic acid can be used to form these polymers including such monomers as ethylene and propylene which act as diluents, and maleic anhydride which acts as a source of additional carboxylic groups.

Exemplary clay thickeners comprise, for example, colloid-forming clays, for example, such as smectite and attapulgite types of clay thickeners. The clay materials can be described as expandable layered clays, i.e., aluminosilicates and magnesium silicates. The term "expandable" as used to describe the instant clays relates to the ability of the layered clay structure to be swollen, or expanded, on contact with water. The expandable clays used herein are those materials classified geologically as smectites (or montmorillonite) and attapulgites (or polygorskites).

Preferred thickeners are those which provide a useful viscosity increasing benefit at the ultimate pH of the compositions, particularly thickeners which are useful at pH's of about 3 or less. While in certain embodiments the compositions may comprise a thicker constituent, it is generally preferred the compositions exhibit viscosities similar to that of water. The compositions preferably have a viscosity of not more than about 50 cps at room temperature, more preferably have a viscosity of not more than about 30 cps at room temperature.

As is noted above, the compositions according to the invention are largely aqueous in nature. Water is added to order to provide to 100% by weight of the compositions of the invention. The water may be tap water, but is preferably distilled and is most preferably deionized water. If the water is tap water, it is preferably substantially free of any undesirable impurities such as organics or inorganics, especially minerals salts which are present in hard water which may thus undesirably interfere with the operation of the constituents present in the aqueous compositions according to the invention. Preferably at least 80% wt, more preferably at least 85% wt of the compositions are water.

According to certain specific preferred embodiments there is provided a highly aqueous liquid acidic hard surface cleaning composition having a pH of about 2 or less, preferably having pH of about 0.2-1 which necessarily comprises:

1-15, preferably 5-12% wt. of an acid constituent comprising a ternary acid system consisting of formic acid, sulfamic acid and oxalic acid wherein the total amount of sulfamic acid is at least equal to or in excess of the total amount of the formic and oxalic acid, optionally further comprising one or more further co-acids based on inorganic or organic acids;

0.01-10% wt. of an organic solvent constituent which comprises at least one glycol ether solvent selected from the group: phenyl containing glycol ether solvents especially propylene glycol phenyl ether, propylene glycol n-propyl ether and dipropylene glycol n-butyl ether, but is preferably solely propylene glycol n-propyl ether or is solely propylene glycol n-propyl ether with at least one phenyl containing glycol ether solvents especially propylene glycol phenyl ether, and further, wherein the organic solvent constituent excludes further organic co-solvents;

0.01-5% wt. of at least one nonionic surfactant based on monobranched alkoxylated C10/C11-fatty alcohols;

optionally 0.01-5% wt. of a cosurfactant constituent, including one or more nonionic, cationic, amphoteric or zwitterionic surfactants and most desirably wherein the cosurfactant constituent consists solely of one or more nonionic surfactants;

optionally 0.01-5% wt. of one or more further constituents selected coloring agents, fragrances and fragrance solubilizers, viscosity modifying agents including one or more thickeners, pH adjusting agents and pH buffers including organic and inorganic salts, optical brighteners, opacifying agents, hydrotropes, abrasives, and preservatives, as well as other optional constituents known to the art;

and the balance, water, wherein water comprises at least 80% wt. of the composition.

The compositions according to the invention are desirably provided as a ready to use product which may be directly applied to a hard surface. Hard surfaces which are to be particularly denoted are lavatory fixtures, lavatory appliances (toilets, bidets, shower stalls, bathtubs and bathing appliances), wall and flooring surfaces especially those which include refractory materials and the like. Further hard surfaces which are particularly denoted are those associated with dishwashers, kitchen environments and other environments associated with food preparation. Hard surfaces which are those associated with hospital environments, medical laboratories and medical treatment environments. Such hard surfaces described above are to be understood as being recited by way of illustration and not be way of limitation.

The inventive compositions may be packaged in any suitable container particularly flasks or bottles, including squeeze-type bottles, as well as bottles provided with a spray apparatus which is used to dispense the composition by spraying. The inventive compositions are readily pourable and readily pumpable cleaning compositions which features the benefits described above. Accordingly the inventive compositions are desirably provided as a ready to use product in a manually operated spray dispensing container, or may be supplied in aerosolized product wherein it is discharged from a pressurized aerosol container. Propellants which may be used are well known and conventional in the art and include, for example, a hydrocarbon, of from 1 to 10 carbon atoms, such as n-propane, n-butane, isobutane, n-pentane, isopentane, and mixtures thereof; dimethyl ether and blends thereof as well as individual or mixtures of chloro-, chlorofluoro- and/or fluorohydrocarbons- and/or hydrochlorofluorocarbons (HCFCs). Useful commercially available compositions include A-70 (Aerosol compositions with a vapor pressure of 70 psig available from companies such as Diversified and Aeropress) and Dymel® 152a (1,1-difluoroethane from DuPont). Compressed gases such as carbon dioxide, compressed air, nitrogen, and possibly dense or supercritical fluids may also be used. In such an application, the composition is dispensed by activating the release nozzle of said aerosol type container onto the area in need of treatment, and in accordance with a manner as above-described the area is treated (e.g., cleaned and/or sanitized and/or disinfected). If a propellant is used, it will generally be in an amount of from about 1% to about 50% of the aerosol formulation with preferred amounts being from about 2% to about 25%, more preferably from about 5% to about 15%. Generally speaking, the amount of a particular propellant employed should provide an internal pressure of from about 20 to about 150 psig at 70° F.

The compositions according to the invention can also be suited for use in a consumer "spray and wipe" application as a cleaning composition. In such an application, the consumer generally applies an effective amount of the composition using the pump and within a few moments thereafter, wipes off the treated area with a rag, towel, or sponge, usually a disposable paper towel or sponge. In certain applications, however, especially where undesirable stain deposits are heavy, the cleaning composition according to the invention may be left on the stained area until it has effectively loosened the stain deposits after which it may then be wiped off, rinsed off, or otherwise removed. For particularly heavy deposits of such undesired stains, multiple applications may also be used. Optionally, after the composition has remained on the surface for a period of time, it could be rinsed or wiped from the surface.

It is contemplated that certain preferred embodiments of inventive formulations may also provide a disinfecting or sanitizing benefit to hard surfaces wherein the presence of undesired microorganisms are suspected such as gram positive or gram negative bacteria. This is due to the low pH of particularly preferred embodiments of the invention, particularly wherein the compositions are at a pH of 3 or less, preferably at a pH of 2 or less and most preferably at a pH of about 1.75 or less. Also provided is a method for the treatment of hard surfaces wherein the presence of such undesired microorganisms are suspected which method includes the step of applying a disinfecting or sanitizing effective amount of a composition described herein.

Whereas the compositions of the present invention are intended to be used in the types of liquid forms described, nothing in this specification shall be understood as to limit the use of the composition according to the invention with a further amount of water to form a cleaning solution therefrom. In such a proposed diluted cleaning solution, the greater the proportion of water added to form said cleaning dilution will, the greater may be the reduction of the rate and/or efficacy of the thus formed cleaning solution. Accordingly, longer residence times upon the stain to effect their loosening and/or the usage of greater amounts may be necessitated. Conversely, nothing in the specification shall be also understood to limit the forming of a "super-concentrated" cleaning composition based upon the composition described above. Such a super-concentrated ingredient composition is essentially the same as the cleaning compositions described above except in that they include a lesser amount of water.

The composition of the present invention, whether as described herein or in a concentrate or super concentrate form, can also be applied to a hard surface by the use of a carrier substrate. One example of a useful carrier substrate is a wet wipe. The wipe can be of a woven or non-woven nature. Fabric substrates can include nonwoven or woven pouches, sponges including both closed cell and open celled sponges, including sponges formed from celluloses as well as other polymeric material, as well as in the form of abrasive or non-abrasive cleaning pads. Such fabrics are known commercially in this field and are often referred to as wipes. Such substrates can be resin bonded, hydroentangled, thermally bonded, meltblown, needlepunched, or any combination of the former. The carrier substrate useful with the present inventive compositions may also be a wipe which includes a film forming substrate such as a water soluble polymer. Such self-supporting film substrates may be sandwiched between layers of fabric substrates and heat sealed to form a useful substrate.

The compositions of the present invention are advantageously absorbed onto the carrier substrate, i.e., a wipe to form a saturated wipe. The wipe can then be sealed individually in a pouch which can then be opened when needed or a multitude of wipes can be placed in a container for use on an as needed basis. The container, when closed, sufficiently sealed to prevent evaporation of any components from the compositions. In use, a wipe is removed from the container and then wiped across an area in need of treatment; in case of difficult to treat stains the wipe may be re-wiped across the area in need of treatment, or a plurality of saturated wipes may also be used.

Certain embodiments of the invention, including certain particularly preferred embodiments of the invention are disclosed in the following examples.

EXAMPLES

A number of formulations were produced by mixing the constituents outlined in Table 1 by adding the individual constituents into a beaker of deionized water at room temperature which was stirred with a conventional magnetic stirring rod. Stirring continued until the formulation was homogenous in appearance. It is to be noted that the constituents might be added in any order, but it is preferred that a first premixture is made of any fragrance constituent with one or more surfactants used in the inventive compositions. Thereafter, a major amount of water is first provided to a suitable mixing vessel or apparatus as it is the major constituent and thereafter the further constituents are added thereto convenient. The order of addition is not critical, but good results are obtained where the surfactants (which may be also the premixture of the fragrance and surfactants) are added to the water prior to the remaining constituents.

The exact compositions of the example formulations are listed on Table 1, below, and are identified by one or more digits preceded by the letter "E". Certain comparative compositions are also disclosed on Table 1, and are identified by one or more digits preceded by the letter "C".

TABLE 1

| | E1 | E2 |
|---|---|---|
| sulfamic acid (99.5%) | 5.0 | 5.0 |
| formic acid (95%) | 2.69 | 1.64 |
| oxalic acid (99.5%) | 2.0 | 2.0 |
| Lutensol XL 79 (80-90%) | 1.3 | 1.3 |
| Empilan KR6 (99.5%) | 0.5 | 0.5 |
| Dowanol PnP (95%) | 0.3 | 0.3 |
| colorant (1% wt.) | 0.05 | 0.05 |
| fragrance | 0.15 | 0.15 |
| deionized water | q.s. | q.s. |
| pH | <1 | <1 |

All of the formulations on the foregoing Table 1 are indicated in weight percent, and each composition comprised 100% wt. The individual constituents were used, "as-supplied" from their respective source and unless otherwise indicated, each of the constituents are to be understood as being "100% wt. actives". Deionized water was added in quantum sufficient, "q.s.", to provide the balance to 100% wt. of each of the example compositions. The sources of the constituents used in the formulations of Tables 1 are described on the following Table 2.

TABLE 2

| | |
|---|---|
| sulfamic acid (99.5%) | anhydrous sulfamic acid, 99.5% wt. actives |
| oxalic acid (99.5%) | oxalic acid, % wt. actives |
| formic acid (94%) | aqueous solution, formic acid, 94-95% wt. actives |
| Lutensol XL 79 (80-90%) | C10-Guerbet alcohol ethoxylate, 7 moles ethoxylation (ex. BASF) (80-90% wt. actives) |
| Empilan KR6 (99.5%) | nonionic surfactant, C9-11 alcohol ethoxylate, 6 moles of ethoxylation (100% wt. actives) |
| Dowanol PnP (95%) | propylene glycol n-propyl ether supplied as Dowanol PnP (ex. Dow Chem. Co.), 95% wt. actives |
| fragrance | fragrance composition, proprietary composition of its supplier |
| colorant | aqueous dispersion of a C.I. Acid dye (1% wt. actives) |
| di water | deionized water |

For comparative purposes the performance of the compositions of the invention were compared to the performance of several commercially available preparations, which are identified on the following table, whose constituents are also indicated thereon. The identity of the constituents was determined from information publicly disclosed by the respective supplier, while the pH was determined according to the use of a conventional laboratory pH meter of each sample.

| Example | Commercial Product: | Constituents: |
|---|---|---|
| C1 | ANTIKAL Limescale Remover (ex. Procter & Gamble Co.); pH = 1.2 | water<br>phosphoric acid<br>C9-C11 pareth-8<br>formic acid<br>xanthan gum<br>perfume<br>etidronic acid<br>PVP<br>sodium hydroxide<br>colorant<br>citronellol<br>limonene |

-continued

| Example | Commercial Product: | Constituents: |
|---|---|---|
| C2 | BREF Power-Reiniger (ex. Henkel KGAA); pH = 1.4 | water<br>citric acid<br>decyl glucoside<br>phosphoric acid<br>formic acid<br>perfume<br>limonene |
| C3 | MR PROPER Éclair Spray surpuissant (ex. Procter & Gamble Co.); pH = 1.0 | water<br>phosphoric acid<br>C9-C11 pareth-8<br>N-butoxypropoxypropanol<br>formic acid<br>sodium caprylyl sulfonate<br>lauramine oxide<br>perfume<br>etidronic acid<br>sodium sulfate<br>citronellol<br>limonene |
| C4 | MR PROPER Salle de Bains spray (ex. Procter & Gamble Co.); pH = 3.6 | water<br>sodium citrate<br>sodium C12-C13 alkyl sulfate<br>dipropylene glycol<br>butyl ether<br>C9-C11 pareth-8<br>perfume<br>xanthan gum<br>citric acid<br>PVP<br>dipropylene glycol<br>benzisothiazolinone<br>sodium hydroxide<br>hexyl cinnamal<br>butylphenyl<br>methylpropional |
| C5 | CIF pistolet Power Cream Salle de Bain (ex. Unilever); pH = 3.8 | water<br>monosodium citrate<br>undeceth-10<br>PPG-2 butyl ether<br>citric acid<br>styrene/acrylates<br>copolymer<br>perfume<br>xanthan gum<br>limonene<br>benzisothiazolinone |
| C6 | CIF Cuisine et Salle de Bain (ex. Unilever); pH = 3.5 | water<br>C9-C11 pareth-5<br>monosodium citrate<br>sodium cumene sulfonate<br>citric acid<br>sodium polyacrylate<br>sodium salicylate<br>perfume<br>salicylic acid<br>limonene |

The foregoing compositions were used, as commercially supplied in their respective product packaging. In certain tests, deionized water or "d.i. water" was used as a further comparative example.

Several of the foregoing compositions were tested and evaluated according to one or more of the following test protocols.

Soap Scum Cleaning Evaluation:

The efficacy of the example compositions according to the invention as well as that of the commercially available products in removing soap scum from a hard surface was evaluated. The test protocol used was that established by the German Cosmetic, Toiletry, Perfumery and Detergent Association (IKW, viz., the "Industrieverband Körperpflege- und Waschmittel e.V.") and published as "Recommendations for the Quality Assessment of Bathroom Cleaners" (version 2002), published in the SÖFW-Journal, 129, November, 2003. The specific test of the published tests used based on that under "3.2 Determination of the cleaner's ability to remove lime soaps", which was generally adhered to as indicated in the following.

For this test high-gloss white ceramic tiles (4 inch by 4 inch glazed glossy white ceramic bathroom tiles), were initially cleaned with a mild abrasive cleaner, rinsed with water and wiped with ethanol. Subsequently the tiles are dried for 1 hour at 180° C. in a preheated drying cabinet and then weighed.

The test soil used was a calcium stearate suspension of the following composition:

85.0% ethanol, 96 MEK (denatured)
5.0% calcium stearate, fine
9.8% water, demineralized
0.2% soot/special black 4

Ethanol was made ready and calcium stearate was stirred into it. Then water and soot were added. The suspension was placed in an ultrasonic bath for 10 minutes and subsequently homogenized over 3 minutes with a Turrax (approx. 5000/min).

The suspension was applied onto the tiles from a distance of approximately. 25 cm with an airbrush pistol, (e.g. Badger model 150 with jet L). As a consequence of adjusting the airbrush system some of the ethanol was blown out by the compressed air (recommended pressure 2 bar), therefore the quantity to be applied was determined in pretests.

The tiles were dried for 1 hour at room temperature and then stored for 1 hour in a horizontal position in a preheated circulating drying oven at 180° C. in order to melt the calcium stearate. Cooling was allowed to take place for approx. 1 hour in the switched off and slightly opened drying oven. The effectively applied mass of calcium stearate was calculated by another weighing and by determining the difference in weight compared with the empty, dried tile. According to the mass of the 5% calcium stearate suspension was applied (=5 g), in the test only tiles are used onto which 0.13 g±0.01 g of calcium stearate had been melted. Before testing the tiles were stored for at least 24 hours at room temperature.

Testing was carried out in the form of a six fold determination. For this purpose 0.5 ml of undiluted cleaner was placed with a pipette on an area of 3×2 cm on the tile for one of several contact times. Each of the tested compositions were evaluated by using six tile replicates for each contact time tested. The contact times were 2.5 minutes, 5 minutes, 7 minutes and 10 minutes. Subsequently each tile was rinsed under running water, and the loosened calcium stearate was removed mechanically by wiping a moist, fine-pored viscose sponge (approx. 90×40×40 mm) once across the surface of the tile without applying any pressure Then each tile was rinsed with fully demineralized water and dried at room temperature.

After drying the cleaning performance of each test tile and composition was visually assessed by six trained observers for each test tile, who estimated the soil removal in percent. To reduce variations of assessments, the observers were trained using suitable evaluation samples. The cleaning performance for each of the exposure times was arrived at from the mean value of the reported soil removal for each tested composition as reported by the six trained observers.

The results are reported on the following table.

TABLE

| Soap Scum Cleaning | | | | | | | | |
|---|---|---|---|---|---|---|---|---|
| Contact | % removal | | | | | | | |
| time: | E1 | C1 | C2 | C3 | C4 | C5 | C6 | d.i. water |
| 2.5 minutes | 98.58 | 61.17 | 96.75 | 97.54 | 32.83 | 13.12 | 0.12 | 0 |
| 5 minutes | 100 | 96.5 | 100 | 100 | 78.96 | 78.08 | 16.33 | 0.04 |
| 7.5 minutes | 100 | 100 | 100 | 100 | 92.21 | 94.33 | 82.37 | —* |
| 10 minutes | 100 | 100 | 100 | 100 | 100 | 100 | 93.54 | 0.08 |

—* not tested

As can be seen from the foregoing the compositions according to the invention provided excellent cleaning results especially at the initial contact time interval of 2.5 minutes, superior to C1 and comparable in performance to the C2 and C3 compositions.

Greasy Soil Cleaning Evaluation:

Cleaning evaluations for greasy soils were performed generally in accordance with the testing protocol outlined according to ASTM D4488 A2 Test Method, which evaluated the efficacy of the cleaning compositions on masonite wallboard samples painted with wall paint. The soil applied was a greasy soil sample containing vegetable oil, food shortening and animal fat. The sponge (water dampened) of a Gardner Abrasion Tester apparatus was squirted with a 15 gram sample of a tested cleaning composition, and the apparatus was cycled 3 times. The evaluation of cleaning compositions was "paired" with one side of each of the test samples treated with a composition according to the invention, and the other side of the same sample treated with a comparative example's composition, thus allowing a "side-by-side" comparison to be made. Each of these tests were duplicated on 4 wallboard tiles and the results statistically analyzed and the averaged results reported the table below.

The cleaning efficacy of the tested compositions were evaluated the cleaning efficacy of the tested compositions was evaluated utilizing a high resolution digital imaging system which evaluated the light reflectance characteristics of the each tested sample wallboard sample. This system utilized a photographic copy stand mounted within a light box housing which provided diffuse, reflected light supplied by two 15 watt, 18 inch type T8 fluorescent bulbs rated to have a color output of 4100K which approximated "natural sunlight" as noted by the manufacturer. The two fluorescent bulbs were positioned parallel to one another and placed parallel and beyond two opposite sides of the test substrate (test tile) and in a common horizontal plane parallel to the upper surface of the test substrate being evaluated, and between the upper surface of the tile and the front element of the lens of a CCD camera. The CCD camera was a "QImaging Retiga series" CCD camera, with a Schneider-Kreuznach Cinegon Compact Series lens, f1.9/10 mm, 1 inch format (Schneider-Kreuznach model #21-1001978) which CCD camera was mounted on the copy stand with the lens directed downwardly towards the board of the copy stand on which a test substrate was placed directly beneath the lens. The light box housing enclosed the photographic copy stand, the two 18 inch fluorescent bulbs and a closeable door permitted for the insertion, placement and withdrawal of a test tile which door was closed during exposure of the CCD camera to a test tile. In such a manner, extraneous light and variability of the light source during the evaluation of a series of tested substrates was minimized, also minimizing exposure and reading errors by the CCD camera.

The CCD camera was attached to a desktop computer via a Firewire IEEE 1394 interface and exposure data from the CCD camera was read by a computer program, "Media Cybernetics Image Pro Plus v. 6.0", which was used to evaluate the exposures obtained by the CCD camera, which were subsequently analyzed in accordance with the following. The percentage of the test soil removal from each test substrate (tile) was determined utilizing the following equation:

$$\% \text{ Removal} = \frac{RC - RS}{RO - RS} \times 100$$

where

RC=Reflectance of tile after cleaning with test product

RO=Reflectance of original soiled tile

RS=Reflectance of soiled tile

The tested compositions and their averaged results of % Removal of the test soil are reported on the following table.

| Greasy Soil Cleaning Evaluation | |
|---|---|
| | % Removal |
| E1 | 59.74 |
| C1 | 43.48 |
| C2 | 50.00 |
| C3 | 56.23 |
| C4 | 65.98 |
| C5 | 64.39 |
| C6 | 53.02 |

As is evident from the foregoing, the compositions exhibited comparable or significantly superior cleaning performance of the greasy test soil on the test substrates.

Limescale Removal Evaluation:

The efficacy of certain of the composition disclosed on Table 1 with respect to limescale removal was demonstrated according to the following test protocol: New marble cubes (approx. ¾"×¾" ⅜") were rinsed with copious amounts of de-ionised water and dried for one hour at 105 deg.C. in an oven. The cubes were left to cool and weighed on an analytical balance. 8 ml of a test formulation was added via a syringe or eyedropper to the top of the cubes which were resting in a polymeric or foil balance boat (80 mm×80 mm). The cubes were left in contact with a test composition for 5 minutes, and then were thoroughly rinsed clean with de-ionised water. The cubes were then left to dry for one hour in an oven at 105 deg.C. before being left to cool at room temperature. Subsequently the cubes were then reweighed. For each sample formulation tested, five cubes were tested with each sample formulation. The percentage weight loss of the cubes was calculated using the following formula:

$$\% \text{ limescale dissolved} = \frac{100 \times (\text{initial weight of cube} - \text{final weight of cube})}{\text{initial weight of cube}}$$

The five individual results obtained for each formulation were average and the resulting average of the evaluation are reported on the following Table.

TABLE

| Limescale Removal | |
|---|---|
| | % limescale dissolved |
| E1 | 0.7029 |
| C1 | 0.0958 |
| C2 | 0.3426 |
| C3 | 0.4319 |
| C4 | 0.0564 |
| C5 | 0.0627 |
| C6 | 0.1479 |

From the foregoing reported results, the inventive compositions exhibit significantly and surprisingly superior limescale removal efficacy.

Rust Stain Cleaning Evaluation:

Compositions according to the invention as well as several comparative example compositions were evaluated for their efficacy in the removal of rust stains from hard surfaces generally in accordance with the following protocol.

A standardized rust soil was prepared by combining 98% wt. deionized water at room temperature with 2% ferric chloride which was mixed until a uniform soil composition was formed.

A separate 1% sodium hydroxide solution was also produced by combining 99% wt. deionized water at room temperature with 1% wt. NaOH pellets and mixing until a clear solution was formed.

Both the standardized rust soil and the sodium hydroxide solution were used within 24 hours of their production.

As substrates, a series of standard type 316 stainless steel plates were used. Each of the plates was washed in water and dried with a paper towel, after which the plates were washed with isopropanol then placed into a vertical rack and dried at room temperature. The reflectance reading of a random tile thus prepared was evaluated using a Minolta Colorimeter which read the reflection of the surface of the tile at 5 points on the surface. The readings thus obtained were averaged, and were used as the reference value for a "clean plate" in later calculations concerning cleaning efficacy.

Next, the dried plates were placed on a flat surface, and using a fine mist sprayer an even coating of the standardized rust soil was applied to an exposed surface of the plate. Subsequently the 1% NaOH aqueous solution was applied to the dried plate surfaces using a fine mist sprayer and again, thereafter the plate surfaces were allowed to dry on a laboratory bench for ½ to 1 hour. The foregoing application procedure was repeated two more times for each plate in order to build up three layer of the standardized rust soil on each plate, thereafter the plates were provided to a laboratory oven and exposed to 110° C. for 15 minutes to ensure thorough drying of the standardized rust soil on each plate, then removed and the plates allowed to cool to room temperature on a laboratory benchtop, where they were kept for 48 hours in order to age prior to being used for further evaluations. The reflectance reading of the each of the prepared, soiled plates was again evaluated as above, using a Minolta Colorimeter which read the reflection of the surface of the tile at 5 points on the surface in the manner disclosed above. The readings thus obtained were averaged, and were used as the reference value for the "soiled plate" which was later treated with a composition.

To evaluate rust removal efficacy, 2 ml of each test composition was applied by pipetting to the soiled surface of a plate, and allowed to stand for 1 minute. Thereafter the plate was rinsed in a stream of cold tap water for 10 to 15 seconds, then the plate was placed in a Gardner Abrasion Tester and secured. A moistened sponge was placed in the holder of the Tester, and the device was cycled six times. Thereafter the plate was removed and the surface reflectance, an indicator of the rust removal efficacy of the tested composition was evaluated a Minolta Colorimeter CR-231 in order to determine the change in reflectance between the original reflectance value of the soiled plate, and the reflectance of a soiled tile which was cleaned using a quantity of a tested composition in accordance with the test protocol described above.

According to the reflective means, the percentage of rust removal was determined utilizing the following equation:

$$\% \text{ Removal} = \frac{RC - RS}{RO - RS} \times 100$$

where

RC=Reflectance of plate after cleaning with test product

RO=Reflectance of original soiled plate

RS=Reflectance of soiled plate

For each plate, five readings were taken and the results averaged to provide a median reading for each tile. Four tile replicate tiles were used to evaluate each of the tested comparative compositions, but 14 tile replicate tiles were used to evaluate the composition according to the invention. The % Removal using a particular tested composition is reported on the following table.

TABLE

Rust Stain Cleaning

| | % removed |
|---|---|
| E1 | 76.89 |
| C1 | 37.92 |
| C2 | 36.96 |
| C3 | 39.71 |
| C4 | 38.01 |
| C5 | 31.00 |
| C6 | 37.00 |

As can be seen from the results of the foregoing table, the compositions of the invention exhibited dramatically superior cleaning performance of rust stains compared to the comparative compositions tested.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the appended claims.

The invention claimed is:

1. An aqueous liquid acidic hard surface cleaning composition having a pH of about 3 or less which comprises:

an acid constituent; which consists of a ternary acid system which includes each of formic acid, oxalic acid, and sulfamic acid;

at least one nonionic surfactant based on monobranched alkoxylated C10/C11-fatty alcohols;

an organic solvent constituent which comprises at least one glycol ether solvent;

optionally a cosurfactant constituent, including one or more nonionic, cationic, amphoteric or zwitterionic surfactants;

optionally one or more further constituents selected coloring agents, fragrances and fragrance solubilizers, viscosity modifying agents including one or more thickeners, pH adjusting agents and pH buffers including organic and inorganic salts, optical brighteners, opacifying agents, hydrotropes, abrasives, and preservatives, as well as other optional constituents known to the art;

and the balance, water, wherein water comprises at least 80% wt. of the composition.

2. A highly aqueous liquid acidic hard surface cleaning composition according to claim 1 wherein the total amount of sulfamic acid is at least equal to or in excess of the total amount of the formic and oxalic acid present in the composition.

3. A highly aqueous liquid acidic hard surface cleaning composition according to claim 1 wherein oxalic acid is present in an amount of at least 1.5% wt.

4. A highly aqueous liquid acidic hard surface cleaning composition according to claim 1 wherein formic acid, sulfamic acid and oxalic acid are present in weight ratios of sulfamic acid:formic acid:oxalic acid of 2:0.5-1.5:0.5-1.5.

5. A highly aqueous liquid acidic hard surface cleaning composition according to claim 1 wherein formic acid, sulfamic acid and oxalic acid are present in weight ratios of sulfamic acid:formic acid:oxalic acid of 2:0.5-1.5:0.75-1.5.

6. A highly aqueous liquid acidic hard surface cleaning composition according to claim 1 wherein the pH of the compositions is between 0.001-2.5.

7. A highly aqueous liquid acidic hard surface cleaning composition according to claim 1 wherein the pH of the compositions is between 0.1-2.

8. A highly aqueous liquid acidic hard surface cleaning composition according to claim 1, wherein the acid constituent comprises 5-12% wt. of the composition.

9. A highly aqueous liquid acidic hard surface cleaning composition according to claim 1, wherein the organic solvent constituent comprises a glycol ether solvent which mitigates or masks malodors of the acid constituent.

10. A highly aqueous liquid acidic hard surface cleaning composition according to claim 1, wherein the organic solvent constituent comprises a glycol ether solvent which mitigates or masks malodors of the acid constituent, and further wherein the acid constituent comprises formic acid.

11. A highly aqueous liquid acidic hard surface cleaning composition according to claim 1, wherein the organic solvent constituent comprises a glycol ether solvent which mitigates or masks malodors of the acid constituent.

* * * * *